US006035599A

United States Patent [19]

Sonnentag

[11] Patent Number: 6,035,599

[45] Date of Patent: Mar. 14, 2000

[54] CORNER BLOCK SYSTEM FOR RETAINING WALL

[75] Inventor: Timothy J. Sonnentag, Marathon, Wis.

[73] Assignee: County Concrete Corporation, Marathon, Wis.

[21] Appl. No.: 09/080,939

[22] Filed: May 19, 1998

[51] Int. Cl.[7] ..... E04B 5/04

[52] U.S. Cl. ..... 52/604; 52/105; 52/284; 52/285.4; 52/585.1; 52/591.1; 52/606; 52/608

[58] Field of Search ..... 52/105, 284, 285.4, 52/585.1, 591.1, 604, 606, 608; 405/284

[56] References Cited

U.S. PATENT DOCUMENTS

| | | | |
|---|---|---|---|
| 868,838 | 10/1907 | Brewington | 52/604 |
| 3,650,079 | 3/1972 | Lubin . | |
| 4,802,320 | 2/1989 | Forsberg | 52/585.1 |
| 4,909,010 | 3/1990 | Gravier . | |
| 5,181,362 | 1/1993 | Benitez | 52/591.1 |
| 5,212,925 | 5/1993 | McClinton . | |
| 5,257,880 | 11/1993 | Janopaul, Jr. | 405/284 |
| 5,285,611 | 2/1994 | McClinton . | |
| 5,398,474 | 3/1995 | McClinton . | |
| 5,410,848 | 5/1995 | McClinton et al. . | |
| 5,484,236 | 1/1996 | Gravier . | |
| 5,540,525 | 7/1996 | Miller et al. | 405/284 |
| 5,548,936 | 8/1996 | McClinton et al. . | |
| 5,598,679 | 2/1997 | Orton et al. | 405/284 X |
| 5,623,797 | 4/1997 | Gravier et al. . | |
| 5,711,130 | 1/1998 | Shatley | 52/604 |

FOREIGN PATENT DOCUMENTS 2012286 9/1990 Canada .

*Primary Examiner*—Christopher T. Kent
*Attorney, Agent, or Firm*—Michael Best & Friedrich LLP

[57] ABSTRACT

A multi-coursed stackable block structure having a system for forming a corner. The corner is formed by a two pieced beveled corner unit system to form a miter joint. The beveled corner units are stacked on top of one another to form the corner. A pin and aperture system may be used to reinforce and strengthen the two pieced mitered corner unit system in the wall construction. Additionally, the corner system provides for alternating the length of the corner units such that there is a substantial overlap between the corner units and standard wall block units to maintain the structural integrity of the corner and to maintain a strong structural relationship between the corner the surrounding block units. The corner system also allows for the maintenance of a running half bond in the structure to create a more stable and better visually appearing corner and wall construction.

28 Claims, 3 Drawing Sheets

133
14
22
10
101
26
132
90
68
72
18
190
116
112
108
22c
14c
14b
22b
14a
22a
86
82b
82a
76c
18c
18b
76b
26b
18a
26a

CORNER BLOCK SYSTEM FOR RETAINING WALL

BACKGROUND OF THE INVENTION

This invention relates to stackable block structures, and more particularly to a new corner block unit and system for forming corners in a stackable block structure.

Constructing stackable block structures, such as retaining walls, with block units, such as masonry building block units, presents particular problems. This is especially true with respect to the formation of outside corners of the stackable wall structures.

One such problem includes the fact that many such block units have an outer surface which is intended to be the surface which is to be exposed to increase the aesthetic appearance of the wall. When turning a corner, it is undesirable to have non-outer surface portions of the block unit to be showing.

Additionally, it has been a problem when turning a corner in a stackable block structure to provide for sufficient strength and stability with respect to the corner. Many stackable block structure systems do not allow for lockable engagement between the courses of blocks to substantially reduce the amount of horizontal movement of the corner, or allow for substantial overlap and interlocking between corner block units and standard block units such that the corner is further stabilized. Also, many systems do not allow for lockably maintaining structural reinforcement means such as a geogrid reinforcement mat between the courses of blocks in a corner. Also, in many such systems, it is difficult to maintain a running half bond throughout the remainder of the wall after turning a corner.

Some block systems use a ridge, or lip, at the top front of the blocks to maintain the blocks stacked on top thereof in position. However, such structures do not prevent both backward and forward horizontal movement of the block units. Additionally, they do not allow for a gradual curve in the stackable structure because the ridge, or lip gets in the way. Due to the lip configuration, such corner blocks also mandate that the front of the upper block be setback from the blocks in the course below such that the blocks cannot be stacked directly on top of one another to form a substantially vertical portion of a wall. The ability to vertically stack portions of a wall is especially desirable, for instance, in portions of walls that surround a stairwell going through a main wall.

SUMMARY OF THE INVENTION

A multi-coursed stackable block structure is disclosed having a novel system for forming a corner. The corner is formed by a two pieced beveled corner unit system to form a miter joint. The beveled corner units are stacked on top of one another to form the corner. A novel pin and aperture system may be used to reinforce and strengthen the two pieced mitered corner unit system in the wall construction. Additionally, the corner system provides for alternating the length of the corner units such that there is a substantial overlap between the corner units and standard wall units to maintain the structural integrity of the corner and to maintain a strong structural relationship between the corner the surrounding block units. The corner system also allows for the maintenance of a running half bond in the structure to create a more stable and better visually appearing corner and wall construction.

Additionally, the invention does not use a front lip or ridge type system which inhibits curves and does not allow the vertical stacking of corner block units.

One embodiment of the invention provides a corner block unit for use in creating a corner in a stackable block structure having a plurality of stacked courses wherein each course includes a plurality of blocks and the courses are interlockable with at least one locking pin. The corner block unit includes: a front face; a back surface opposite the front face; a top surface extending between the front face and the back surface; a bottom surface extending between the front face and the back surface; a pin hole extending between the top surface and the bottom surface, the top surface including a locking aperture so that the locking pin inserted through the pin hole of one of the blocks in the course above extends into the locking aperture; and a beveled side surface extending between the front face and the back surface at an angle so that the front face is longer than the back surface.

Another embodiment of the invention provides a stackable block structure having an outside corner, and having a plurality of stacked courses, each course including a plurality of blocks. The block structure includes a first course of blocks including: a first beveled corner block having a front face, a top surface defining a locking aperture, and a beveled side surface; and a second beveled corner block having a front face, and a beveled side surface engaging the beveled side surface of the first beveled corner block such that they form a miter joint and the front faces of the first and second beveled corner blocks define a corner.

The block structure further includes a second course of blocks stacked onto the first course, the second course including: a third beveled corner block stacked onto the first beveled corner block, the third beveled corner block having a front face, a top surface, a bottom surface engaging the top surface of the first beveled corner block, a beveled side surface, and at least one pin hole extending through the third beveled corner block from the top surface of the third beveled corner block to the bottom surface of the third beveled corner block; and a fourth beveled corner block stacked on top of the second beveled corner block, the fourth beveled corner block having a front face, a beveled side surface engaging the beveled side surface of the third beveled corner block such that they form a miter joint and the front faces of the third and fourth beveled corner blocks define a corner.

The block structure also includes a locking pin positioned in the pin hole of the third corner block so that the locking pin extends below the bottom surface of the third corner block and into the locking aperture of the first mitered corner block to fix the position of the first course in relation to the second course.

One feature and an advantage of the present invention is to provide for a system for forming a stackable block structure having a corner therein that allows for locking the courses of the wall together to substantially prevent horizontal movement of the corner courses in relation to one another.

Another feature and an advantage of the present invention is to provide a system for rigidly maintaining structural reinforcement means such as a geogrid reinforcement mat between the courses of blocks in a corner.

Another feature and an advantage of the present invention is to provide a system that allows corner blocks to be stacked vertically, when desired, either on the front face of a wall or the side face of a wall, as a corner is being turned.

Another feature and an advantage of the present invention is to provide a system wherein there is substantial overlap and interlocking between corner block units and standard block units such that the corner is further stabilized by engagement with the standard blocks.

Another feature and an advantage of the present invention is to provide a stackable block system that allows for turning a corner, and maintaining a running bond, such as a running half bond, throughout the remainder of the wall.

Another feature and an advantage of the present invention is to provide a system that allows for a gradual curve to be maintained in the stackable structure when desired.

Other features and an advantages of the present invention will become apparent to those skilled in the art in view of the drawings, the detailed description, and the claims as set forth below.

Figure 1:
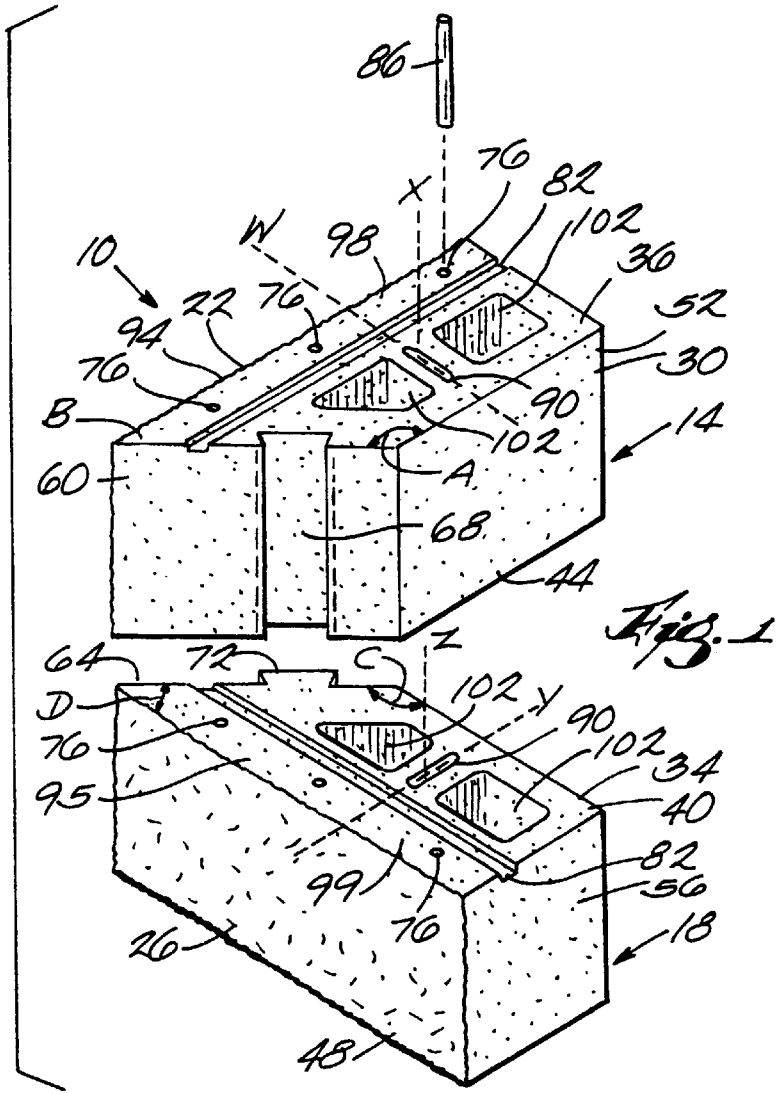
FIG. 1 is a perspective view of the first and second corner block units embodying the present invention.

Before embodiments of the invention are explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DETAILED DESCRIPTION OF THE PREFERRED EMBODIMENTS

FIG. 1 depicts the basic corner brick, or block system 10 of the current invention. The corner block system 10 includes a first corner block unit 14, and a second corner block unit 18. The blocks 14 and 18 may be made of any suitable material for use in forming a stackable block structure. Preferably, the blocks 14 and 18 are made of masonry. The masonry blocks can be made from those materials employed to produce masonry blocks such as cinders, slag, cement, haydite, clay or the like, and are produced through methods generally known in the art.

The blocks 14 and 18 each include a front face 22 and 26, a back surface 30 and 34, a top surface 36 and 40, a bottom surface 44 and 48, a first side surface 52 and 56, and a beveled side surface 60 and 64, respectively.

Referring to block 14 in FIG. 1, the front face 22 is opposite to and preferably, but not necessarily, extends parallel with the back surface 30. The top surface 36 is opposite to and preferably, but not necessarily, extends parallel with the bottom surface 44. The first side surface 52 intersects the back surface 30 and the front face 22. In the illustrated embodiment, the side surface 52 forms an angle of about 90° with both the back surface 30 and the front face 22, but this is not required. The beveled side surface 60 is angled and also intersects the back surface 30 and the front face 22 so that the front face 22 is longer than the back surface 30. The beveled side surface 60 forms an obtuse angle A with the back surface 30. In one embodiment, the angle A is preferably about 135°. The beveled side surface 60 form an acute angle B with the front face 22. In one embodiment, angle B is preferably about 45°.

Similarly, referring to block 18, the front face 26 is opposite to and preferably, but not necessarily, extends parallel with the back surface 34. The top surface 40 is opposite to and preferably, but not necessarily, extends parallel with the bottom surface 48. The first side surface 56 intersect the back surface 34 and the front face 26. In the illustrated embodiment, the side surface 56 forms an angle of about 90° with both the back surface 34 and the front face 26, but this is not required. The beveled side surface 64 is angled and also intersects the back surface 34 and the front face 26 so that the front face 26 is longer than the back surface 34. The beveled side surface 64 forms an obtuse angle C with the back surface 34. In one embodiment, the angle C is preferably about 135°. The beveled side surface 64 form an acute angle D with the front face 26. In one embodiment, angle D is preferably about 45°.

Referring to FIG. 1, the corner block units 14 and 18 are of a size that is generally acceptable for building the stackable structure desired. The front faces 22 and 26 have a length defined by the distance along the front face between the first side surface 52 and 56, and the beveled side surface 60 and 64 respectively. This length defines the length of the block 14 and 18. Preferably, the length is between about 17 and about 18 inches, and most preferably is about 17⅝ inches. The front faces 22 and 26 also have a height defined by the distance along the front face between the top surface 36 and 40, and the bottom surface 44 and 48, respectively. This height defines the height of the block 14 and 18. Preferably, this height is between about 7 and about 8 inches. More preferably, this height is about 7⅝ inches. The first side surfaces 52 and 56 have a width defined by the distance along the first side surface 52 and 56 between the back surface 30 and 34, and the front faces 22 and 26, respectively. This width defines the width of the block 14 and 18. Preferably, this width is between about 7 and about 8 inches, and most preferably is about 7 13/16 inches.

Referring still to FIG. 1, the block 14 and 18 each also include a cut mark or notch 90. The cut notches 90 act as indicators as to where the blocks should be cut, and also may act to facilitate cutting of the block units when necessary, as will be seen below. The cut notches 90 may take the form of any marking or indicator suitable for the purpose, such as an aperture, opening, groove, notch, mark, hole, cavity, depression, or other structure. In the illustrated embodiment, the cut notch 90 in block 14 is an elongated aperture that extends through block 14 from the top surface 36 to the bottom surface bottom surface 44 about horizontal axis w and vertical axis x. Cut notch 90 in block 18 is also an elongated aperture that extends through block 18 from the top surface 40 to the bottom surface bottom surface 48 about horizontal axis y and vertical axis z.

The cut notch 90 define two separate portions of each block 14 and 18. In block 14, the first portion 94 extends from axis w to the beveled side surface 60. The first portion 94 has a length defined by the distance adjacent the front face 26 between axis w and the mitered side surface 60. Preferably, the length of the first portion 94 is between about 11 and about 12 inches, and more preferably is about 11.5 inches. The second portion 98 extends from axis w to the first side surface 56. The second portion 98 has a length defined by the distance between axis w and the first side surface 56 adjacent the front face 26. Preferably, the length of the second portion 98 is between about 6 and about 7 inches, and most preferably is about 6⅛ inches.

In block 18, the first portion 95 extends from axis y to the beveled side surface 64. The first portion 95 has a length defined by the distance adjacent the front face 30 between axis y and the mitered side surface 64. Preferably, the length of the first portion 95 is between about 11 and about 12 inches, and more preferably is about 11.5 inches. The second portion 99 extends from axis y to the first side surface 60. The second portion 99 has a length defined by the distance between axis y and the first side surface 60 adjacent the front face 30. The length of the second portion 99 is preferably between about 6 and about 7 inches, and most preferably about 6⅛ inches.

It is preferable that in each block 14 and 18 the length of the first portion 94 and 95 be greater than the length of the second portion 98 and 99, respectively. It is also preferable that the lengths of both first portions 94 and 95 are about the same, and the lengths of both second portions 98 and 99 are about the same. Additionally, it is preferred that the length of the first portions 94 and 95 be more than half the length of the blocks 14 and 18.

As seen in FIG. 1, both first and second corner blocks 14 and 18 include pin apertures or holes 76 which extend through the blocks from the top surfaces 36 and 40 to the bottom surfaces 44 and 48, respectively.

Additionally, the top surfaces 36 and 40 include locking apertures 82 therein. The locking apertures 82 in the illustrated embodiment are grooves in the top surfaces 36 and 40 which extend from the first side surface 52 and 56 to the beveled side surfaces 60 and 64, respectively. However, other variations of the locking apertures, such as holes, openings, cavities, depressions, or other means for capturing locking pins are contemplated by the current invention.

As will be seen later, locking pins 86 are inserted into the pin holes 76 of a corner block unit in an upper course of blocks. The inserted pins are positioned in the pin holes such that they extend from the bottom surface and engage the locking aperture 82 of block units in the course of block units just below (see, for example, FIG. 5).

As seen in FIG. 1, the corner blocks 14 and 18 each may also include fill voids 102 which are generally hollow portions of the blocks extending from the top surface to the bottom surface, and which can be filled with fill material when a stackable block structure is constructed.

Figure 2:
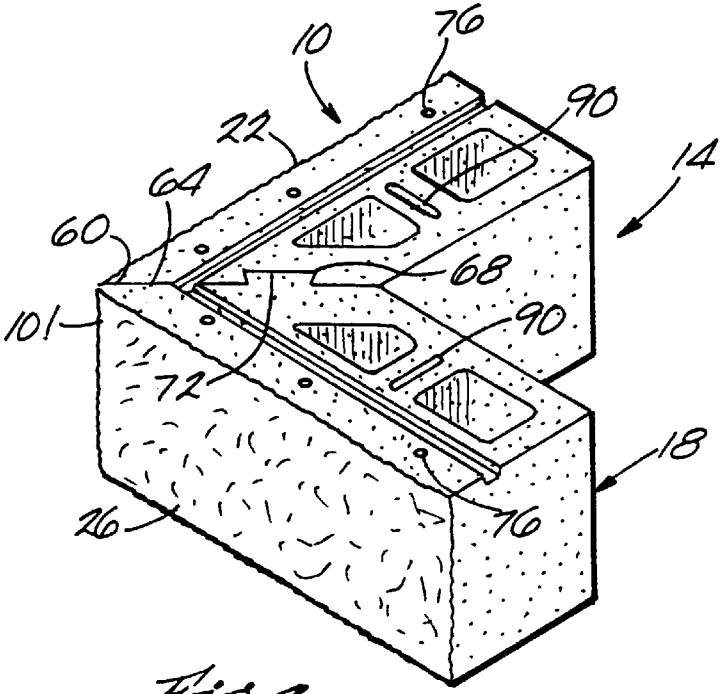
FIG. 2 a perspective view of the first and second block units shown in FIG. 1 as they are engaged to form a miter joint forming a corner.

The beveled side surfaces 60 and 64 are adapted such that they may engage one another to form a miter joint such that the front faces 22 and 26 define a corner 101, as seen in FIG. 2. In the illustrated embodiment, the beveled side surfaces 60 and 64 are angled such that when they are engaged, the front faces 22 and 26 define a corner 101 having an angle of about a 90°. In other embodiments, the angle of the beveled side surfaces 60 and 64 may be modified such that the corner 101 may define different angles that may be greater than or less than 90°.

The corner block units 14 and 18 are intended to be exposed to the environment in which the structure is employed. Therefore, it is preferable, but not necessary, that the block units are made of a material resistant to the detrimental effects of the environment in which they will be used. In one embodiment, the block units are made of a masonry material that has some degree of water resistance. It is contemplated that in other embodiments, it is possible that the front faces 22 and 26 which form the corner 101 are treated such that they are weather resistant and/or aesthetically pleasing. When the block units are made of masonry, such treatments may include glazing, painting, burnishing, polishing, or other treatments generally known in the art. Referring to FIGS. 1 and 2, although it is not necessary, the beveled side faces 60 and 64 may also include connectors 68 and 72 which are used to interconnect the block units 14 and 18. The connectors may include a broad variety of connecting or interlocking mechanisms such as ridges, ripples, grooves, notches, keys, protrusions or other means for creating an interconnecting engagement between the corner block units 14 and 18. Referring to FIGS. 1 and 2, in the illustrated embodiment, the first corner block unit 14 includes a dovetail shaped notch 68, and the second corner block unit 18 includes a correspondingly dovetail shaped key 72. As seen in FIG. 2, the first block 14 may be slid onto the second block 18 by engaging the notch 68 with the key 72 to interconnect the units 14 and 18 such that the beveled side surfaces 60 and 64 engage one another to form the miter joint, and the front faces 22 and 26 define the corner 101. Preferably an adhesive is applied to the first notch and the second key before connecting them to help lock the channel together. It should be understood, however, that the current invention is not limited to the use of such connectors, or limited to the use of the dovetail notch and key arrangement.

Figure 4:
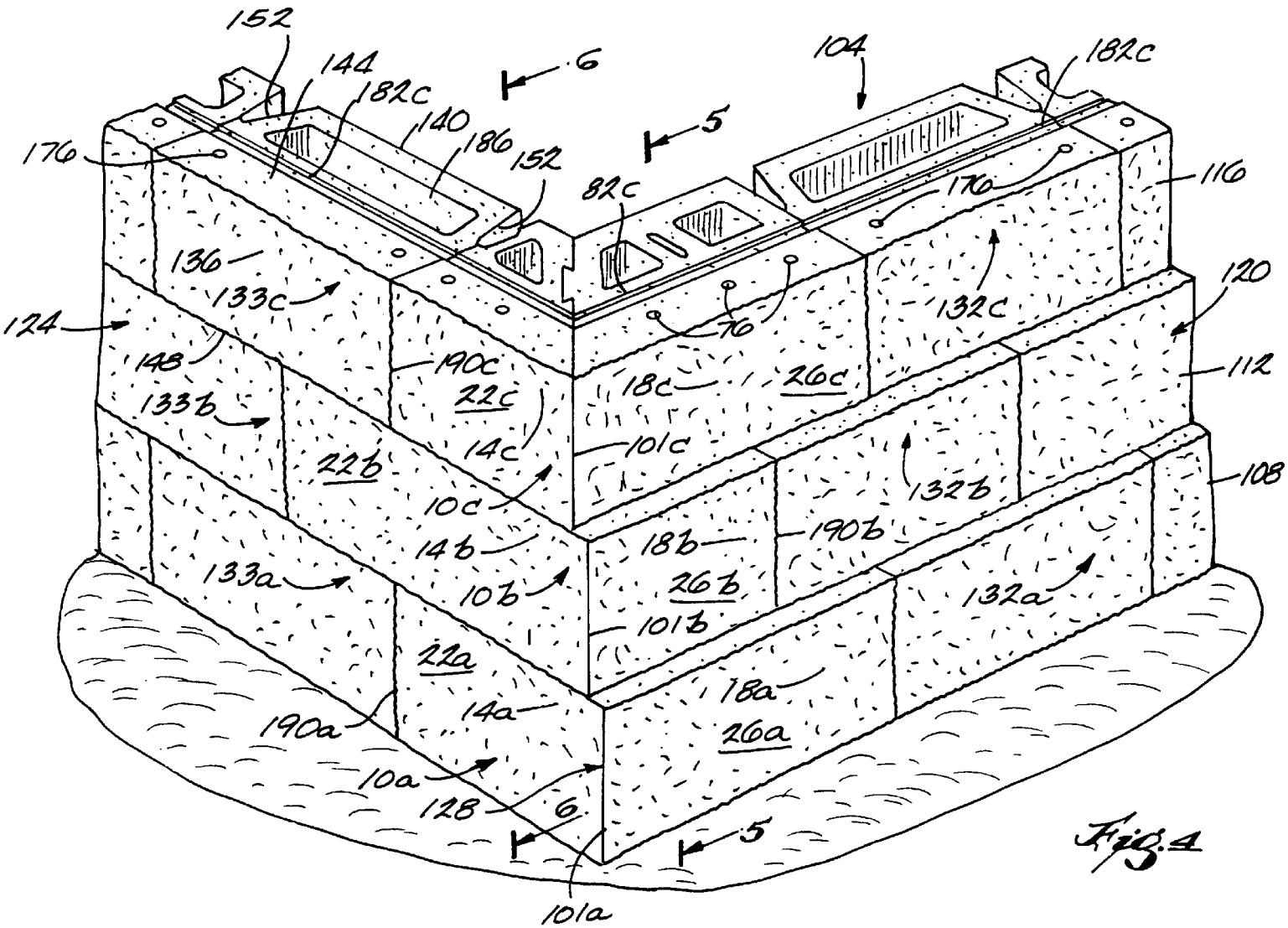
FIG. 4 is a perspective view of a stackable block structure incorporating corner block units embodying the invention.

As will be seen below, and as seen in FIG. 4, the corner block system 10 as discussed above is used in conjunction with standard blocks to form a stackable block structure 104 having a corner 128 therein.

Referring to FIG. 4, a portion of a stackable block structure 104 having a corner 128 embodying the current invention is illustrated. The structure 104 includes a front wall 120 and a side wall 124. The front wall 120 and the side wall 124 meet to define a corner 128. The portion of the structure illustrated includes a series of courses, or layers of blocks, including a first, or base course 108, a second course 112 stacked on top of the base course 108, and a third course 116 stacked on top of the second course 112. It should be understood that the invention is not limited to structures having three courses, and that the invention may be embodied by stackable structures having more or less than three courses.

Figures 3, 5, 6:
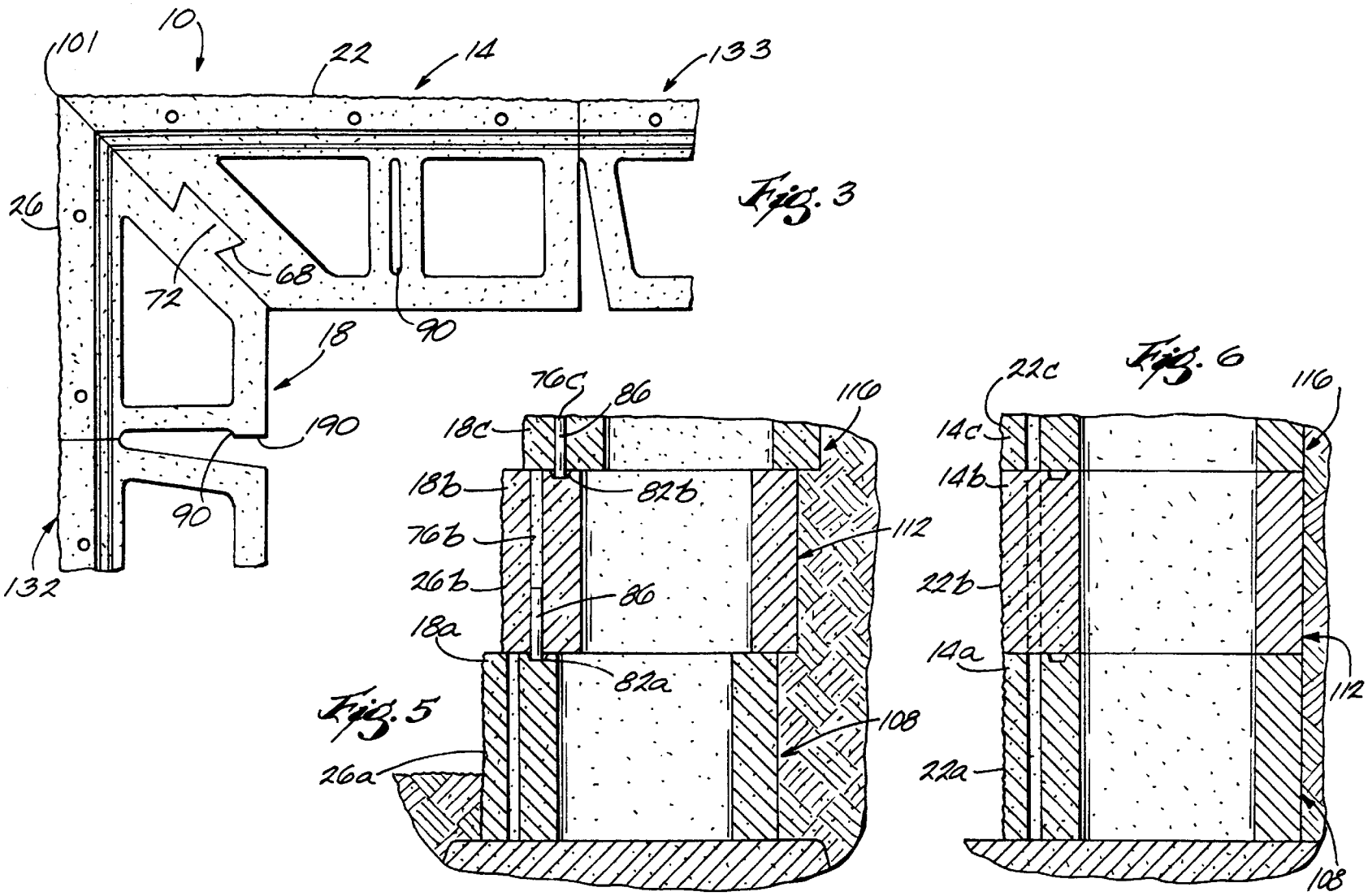
FIG. 3 is a top view of the block units shown in FIG. 1 showing the second corner block unit being cut at the cut groove and showing standard block units placed in line with the corner block units.
FIG. 5 is a sectional view taken along lines 5—5 of FIG. 4.
FIG. 6 is a sectional view taken along lines 6—6 of FIG. 4.

Each of the courses includes a corner block system 10*a*, 10*b*, and 10*c* respectively. The corner block systems 10*a*, 10*b*, and 10*c* in each course are substantially the same as the corner block system 10 described above in reference to FIGS. 1 and 2. The only potential difference between the block system 10 described above and the block systems 10*a*, 10*b*, and 10*c* is the fact that it is preferable to cut one of the corner blocks 14 or 18 at the cut notch 90 to shorten the block. FIG. 3 shows the corner block system 10 including blocks 14 and 18 wherein block 18 was cut at the cut notch, and the second portion 99 was removed, thereby shortening block 18. Standard blocks 132 and 133 are then placed next to the corner blocks to form walls. The corner block 14 or 18 which is cut is preferably alternated from one course to the next. Such an alternating arrangement provides for overlap between the corner blocks and the standard blocks from one course to the next therefore allowing for a running bond pattern to be formed as the structure is built. As used herein, "running bond" means a bond in which each block is laid as a stretcher overlapping the blocks in the adjoining courses. Preferably, the amount of corner block removed in relation to the length of the standard block allows for the maintenance of a running half bond. A running half bond is where one half of the laid block overlaps one half of a first block in the adjoining course, and a second half of the laid block overlaps half of a second block in the adjoining course. A running bond, such as a running half bond, creates a more stable and better visually appearing block structure.

Each course also includes a plurality of standard bricks, or blocks 132*a*, 132*b*, 133*c*, 133*a*, 133*b*, and 133*c* respectively. Referring to FIG. 4, the standard blocks 132*a*, 132*b*, 132*c* and 133*a*, 133*b*, 133*c* are all substantially the same, with the only difference being their placement in the stackable structure 104. The standard blocks labeled with reference numerals 132*a*, 132*b*, and 132*c* are used in the front wall 120, and the standard block units labeled with reference numerals 133*a*, 133*b*, and 133*c* are used in the side wall 124. Each of the blocks 132*a*, 132*b*, 132*c* and 133*a*, 133*b*, 133*c* has generally the same structures and size. Therefore, the structure of only one of the standard blocks, 133*c*, will be described herein, but it should be understood that each of the blocks 132*a*, 132*b*, 132*c* and 133*a*, 133*b*, 133*c* may be described in the same way. Additionally, it should be understood that the invention is not limited to the specific structure of the standard blocks 132*a*, 132*b*, 132*c* and 133*a*, 133*b*, 133*c* as illustrated herein, and that other suitable block structures may be used.

Referring to block 133*c* in FIG. 4, the standard block 133*c* includes a front face 136, a back surface 140, a top surface 144, a bottom surface 148, and opposed side surfaces 152. The front face 136 is opposite to and preferably, but not necessarily, extends parallel with the back surface 140. The top surface 144 is opposite to and preferably, but not necessarily, extends parallel with the bottom surface 148. The opposed side surfaces 152 intersect the back surface 140 and the front face 136.

The front face 136 has a length defined by the distance along the front face 136 between the opposed side surfaces 152. Preferably, the length is between about 12 and about 13 inches, and most preferably is about 12½ inches. The front face 136 also has a height defined by the distance along the front face 136 between the top surface 144, and the bottom surface 148. Preferably, this height is between about 7 and about 8 inches, and more preferably, is about 7⅝ inches. The opposed side surfaces 152 has a width defined by the distance along the opposed side surface 152 between the back surface 140, and the front face 136. Preferably, this width is between about 7 and about 8 inches, and most preferably is about 7 13/16 inches.

Referring still to FIG. 4, the block 133*c* also includes pin holes 176 which extend through the block 133*c* from the top surface 144 to the bottom surface 148. Additionally, the top surface 144 includes a locking aperture 182 therein. The locking apertures 182 in the illustrated embodiment, like the locking apertures 82 in the corner block units 14 and 18, are grooves in the top surfaces 144 which extend from one opposed side surface 152 to the other. However, other variations of the locking apertures, such as holes, openings, cavities, depressions, or other means for capturing locking pins are contemplated by the current invention.

The block 133*c* also includes fill voids 186 which are generally hollow portions of the block units extending from the top surface 144 to the bottom surface 148, and which can be filled with fill material when a stackable block structure is constructed.

In the structure 104 illustrated in FIG. 4, the first course 108 includes a corner block system 10*a* including a first beveled corner block 14*a* and a second beveled corner block 18*a*. Preferably, one of the blocks 14*a* or 18*a* is cut at the cut notch to shorten the block. The shortened block will have the effect of providing for a running bond arrangement as the rest of the structure is built.

In the illustrated embodiment, block 14*a* was cut at the cut notch such that the block 14*a* is shorter than the block 18*a* and has a cut side surface 190*a*. The blocks 14*a* and 18*a* engage one another to form a miter joint and the front faces 22*a* and 26*a* define a corner 101*a* which partially defines the corner 128 in the structure 104. The front faces 22*a* and 26*a* partially define the front wall 120 and side wall 124 respectively. Standard block units 133*a* and 132*a* are then placed along the side surfaces of the corner units 14*a* and 18*a* respectively such that the front faces of the blocks 133*a* and 132*a* are in alignment with the front faces 22*a* and 26*a* of the blocks 14*a* and 18*a*, respectively.

The second course 112 of blocks is stacked onto the first course 108. The second course 112 includes a corner block system 10*b* including a first beveled corner block 14*b* and a second beveled corner block 18*b*. Preferably, one of the blocks 14*b* or 18*b* is cut at the cut notch, as appropriate, to provide for a running bond pattern in relation to the first course. In the embodiment shown, the second beveled corner block 18*b* was cut at the cut notch, and is shorter than both block 14*b* and block 18*a*. A cut surface 190*b* is formed in the block 18*b*. The corner blocks 14*b* and 18*b* engage one another to form a miter joint and the front faces 22*b* and 26*b* define a corner 101*b* which further defines the corner 128 in the structure 104. Standard block units 133*b* and 132*b* are along the side surfaces of the corner units 14*b* and 18*b*, respectively, such that the front faces of the standard blocks 133*b* and 132*b* are in alignment with the front faces 22*b* and 26*b* of the corner block units 14*b* and 18*b*, respectively.

Referring now to FIGS. 4 and 5, the block 18*b* is stacked onto block 18*a* such that the pin holes 76*b* of block 18*b* line up with the locking aperture 82*a* in block 18*a*. Such an arrangement causes the face 26*b* of block 18*b* to be set-back from the face 26*a* of block 18*a*, and the entire second course 112 to be set-back in relation to the first course 108 along the front wall 120. Preferably, the distance of the set-back is about 1 inch. Locking pins 86 are inserted into the pin holes 76*b* of block 18*b* so that the locking pins 86 extends beyond the bottom surface of the block 18*b* and into the locking aperture 82*a* of the block 18*a*. (See FIG. 5). Additionally, locking pins 86 are inserted into the pin holes of standard blocks 132*b* such that the locking pin 86 extends beyond the bottom surface of the blocks 132*b* and into the locking apertures of the blocks in the first course 108 below blocks 132*b*.

As seen in FIG. 4, the block 132*b* adjacent block 18*b* is stacked partially onto block 18*a* and partially onto block 132*a* adjacent block 18*a*. A locking pin 86 inserted into one of the pin holes of the block 132*b* adjacent block 18*b* extends beyond the bottom surface of the block 132*b* and into the locking aperture 82 of the block 18*a*. A locking pin 86 inserted into another of the pin holes of the block 132*b* extends beyond the bottom surface of the block 132*b* and into the locking aperture of a standard block 132*a* adjacent block 18*a*. This overlapping, or running bond, pattern is continued such that the blocks in the first and second courses 108 and 112 overlap and interconnect with each other to form a more stable and structurally sound corner 128, and a better visually appearing structure 104.

Referring now to FIGS. 4 and 6, the block 14*b* is stacked partially onto the block 14*a* and partially onto standard block 133*a*. The block 14*b* is stacked onto the first course 108 such that the front face 22*b* of the block 14*b* is in the same plane with the front face 22*a* of block 14*a* in the first course 108. Such an arrangement provides that the entire second course 112 in the wall 124 is not set back in relation to the first course 108. This vertical stacking arrangement still maintains the overlapping, or running bond pattern, which is continued such that the blocks in the first and second courses 108 and 112 overlap and frictionally engage one another to form a more stable and structurally sound corner 128, and a better visually appearing structure 104.

The third course 116, in turn, is stacked onto the second course 112. The third course 116 includes a corner block system 10*c* including a first beveled corner block 14*c* and a second beveled corner block 18*c*. Preferably, one of the blocks 14*c* and 18*c* is cut, as appropriate, to maintain the running bond pattern. In the embodiment shown, the block 14*c* was cut at the cut notch 90*c* such that the block 14*c* is shorter than both block 18*c* and 14*b*, and has a cut side surface 190*c*. The blocks 14*c* and 18*c* engage one another to form a miter joint and the front faces 22*c* and 26*c* define a corner 101*c* which further defines the corner 128 in the structure 104. The front faces 22*c* and 26*c* partially define the front wall 120 and side wall 124 respectively. Standard block units 133*c* and 132*c* are then placed along the side surfaces of the corner units 14*c* and 18*c* such that the front faces of the blocks 133*c* and 132*c* are in alignment with the front faces 22*c* and 26*c* of the blocks units 14*c* and 18*a*, respectively.

Referring now to FIGS. 4 and 5, the blocks 18*c* and 132*c* are stacked onto blocks 18*b* and 132*b* such that the pin holes 76 and 176 of blocks 18*c* and 132*c* line up with the locking apertures 82*b* in the surface of block units 18*b* and 132*b*. Therefore, the entire third course 116 is set back in relation to the second course 112 along the front wall 120. Locking pins 86 are inserted into the pin holes 76 and 176 of blocks 18*c* and 132*c* so that the locking pins 86 extend beyond the bottom surface of the blocks 18*c* and 132*c* into the locking apertures 82*b* of blocks 18*b* and 132*b*. (See FIG. 5).

Referring now to FIGS. 4 and 6, the block 14*c* is stacked onto the block 14*b* and block 133*c* is also partially stacked onto block 14*b*. The block 14*c* is stacked onto block 14*b* such that the front face 22*c* is in the same plane with the front face 22*b* in the second course 112. Such an arrangement provides that the entire third course 116 in the wall 124 is not set back in relation to the first or second courses 108 and 112. This vertical stacking arrangement still maintains the overlapping, or running bond pattern, which is continued such that the blocks in the second and third courses 112 and 116 overlap and frictionally engage one another to form a more stable and structurally sound corner, and a better visually appearing structure.

As can be seen in FIG. 4, the structure shown is made up of a substantially vertical wall 124 and a set-back wall 120 defining a corner 128. The wall 124 is made up of block units stacked substantially vertically on top of one another, wherein there is no set-back between courses. Wall 120 is made up of a plurality of courses wherein each successive course is set-back from the course immediately below. The combination of the set back wall face 152 as illustrated in FIG. 4, and the vertical wall face 150 as illustrated in FIG. 4, allows for a strong and structurally sound wall unit which allows for versatility in applications. The combination of the vertical stacking arrangement of wall 124 with the set-back stacking arrangement of wall 120 is especially desirable in cases where the wall 124 is to the side of a staircase which runs through wall 120.

In most embodiments, caps or lids (not shown) are placed over the top of the uppermost course of blocks. The caps prevent the loss of fill material in the fill voids, and provide for an aesthetically pleasing finish.

It should also be noted that in other embodiments, the corner blocks and standard blocks may be stacked such that the stacking groove of the lower course always substantially lines up with the pin holes of the next successive upper course so there is a set-back from one course to the next in both walls. In this type of an arrangement, pins can then be inserted into the pin holes such that they extend from the bottom face of the upper course into the locking grooves of the lower course to substantially lock the upper course and the lower course to one another in a horizontal position in both the front wall and the side wall. This embodiment may be preferable in some applications because the locking action of the pins in both the front and side walls provides for more structural integrity in the corner, and in the entire structure.

It should also be noted that in still other embodiments, the corner blocks and standard blocks in both walls surrounding the corner may be stacked substantially vertical upon one another, such that there is no set-back in either wall, to form a structure wherein both the front wall and the side wall are substantially vertical.

The structures disclosed herein are especially valuable as retaining walls wherein dirt or other material are maintained behind the wall. One specific advantage of the current system includes the use of the pin and groove arrangement to reinforce the wall. The locking pin and locking aperture arrangement also allows reinforcement means, such as geogrid, to be maintained securely between each course. The locking pins may act to lock the geogrid in position in relation to the structure.

The invention also provides that the corner block units are being cut such that less than half of the corner block unit is being removed, and more than half of the corner block unit is being used in the corner block system. This allows for more overlap with the corner block, and therefore better frictional engagement between the corner units and the standard units. Such corners are structurally sound, are not easily pushed out, and allow for the easy maintenance of a running bond, such as a running half bond, in the remainder of the structure.

Although several embodiments of the invention have been depicted and described, other embodiments will be apparent to those skilled in the art and are within the intended scope of the present invention. Therefore, the invention is to be limited only by the following claims.

What is claimed is:

1. A corner block unit for use in creating a corner in a stackable block structure having a plurality of stacked courses, each course including a plurality of blocks, said courses being interlockable with at least one locking pin, said corner block unit comprising:

a front face;

a back surface opposite said front face;

a top surface extending between said front face and said back surface;

a bottom surface extending between said front face and said back surface;

a pin hole extending between said top surface and said bottom surface, said top surface including a locking aperture so that the locking pin inserted through the pin hole of one of the blocks in the course above extends into said locking aperture; and a beveled side surface extending between the front face and the back surface at an angle so that the front face is longer than the back surface.

2. The corner block unit of claim 1 wherein said block includes a first end adjacent said beveled side surface and a second end opposite said beveled side surface, and the block has a length defined by the distance along said front face between said first and second ends; and a cut groove in said block unit to facilitate cutting of said unit, said cut groove defining a first portion of the block unit having a length defined by the distance along said front face from said cut groove to said second end, said length of the first portion being less than half the length of the block.

3. The corner block unit of claim 2 wherein the length of the block is between about 17 and about 18 inches, and the length of the first portion of the block being between about 6 and about 7 inches.

4. The corner block unit of claim 1 wherein said beveled side surface includes a connector which is adapted to interconnect said block unit with another block unit.

5. The comer block unit of claim 4 wherein said connector is one of a dovetail shaped notch and a dovetail shaped key.

6. The corner block unit of claim 1 wherein said top surface and said front face intersect to form a front corner, wherein said front corner is in the same horizontal plane as the top surface.

7. A stackable block structure having a corner, and having a plurality of stacked courses, each course including a plurality of blocks, said block structure comprising:

(a) a first course of blocks including:

a first beveled corner block having a front face, a top surface defining a locking aperture, and a beveled side surface; and a second beveled corner block having a front face, and a beveled side surface engaging the beveled side surface of said first beveled corner block such that they form a miter joint and the front faces of the first and second beveled corner blocks define a corner;

(b) a second course of blocks stacked onto said first course, said second course including:

a third beveled corner block stacked onto said first beveled corner block, said third beveled corner block having a front face, a top surface, a bottom surface engaging the top surface of said first beveled corner block, a beveled side surface, and at least one pin hole extending through said third beveled corner block from the top surface of the third beveled corner block to the bottom surface of the third beveled corner block; and a fourth beveled corner block stacked on top of said second beveled corner block, said fourth beveled corner block having a front face, a beveled side surface engaging the beveled side surface of said third beveled corner block such that they form a miter joint and the front faces of the third and fourth beveled corner blocks define a corner; and (c) a locking pin positioned in the pin hole of said third beveled corner block so that the locking pin extends below the bottom surface of said third block and into the locking aperture of said first block to fix the position of the first course in relation to the second course.

8. The stackable block structure of claim 7, further including:

said second beveled corner block including a top surface defining a locking aperture;

at least one pin hole extending through said fourth beveled corner block from the top surface of the fourth beveled corner block to the bottom surface of the fourth beveled corner block; and a second locking pin positioned in the pin hole of said fourth block so that the locking pin extends below the bottom surface of said fourth block and into the locking aperture said second block to fix the position of the first course in relation to the second course.

9. The stackable block structure of claim 7, wherein one of said first and said second beveled corner block units is shorter than an other of said first and said second beveled corner block units.

10. The stackable block structure of claim 7, wherein one of said third and said fourth beveled corner block units is shorter than an other of said third and said fourth beveled corner block units.

11. The stackable block structure of claim 7, wherein said second beveled corner block is shorter than said first beveled corner block, and wherein said third beveled corner block is shorter than said first beveled corner block, and wherein said fourth beveled corner block is longer than said second beveled corner block.

12. The stackable block structure of claim 11, wherein said first and said fourth beveled corner blocks have substantially the same length, and wherein said second and said third beveled corner blocks have substantially the same length.

13. The stackable block structure of claim 12, wherein the length of said first and said fourth beveled corner blocks is between about 17 and about 18 inches, and wherein the length of said second and said third beveled corner blocks is between about 11 and about 12 inches.

14. The stackable block structure of claim 13, wherein said first and said fourth beveled corner blocks have a first length, and said second and said third beveled corner blocks have a second length, wherein the second length is greater than one half of the first length.

15. The stackable block structure of claim 14, wherein the first length is between about 17 and about 18 inches, and the second length is between about 11 and about 12 inches.

16. The stackable block structure of claim 7 wherein said beveled side surfaces of said first and said second beveled corner blocks each include a connector which is adapted to interconnect said first and said second beveled corner blocks.

17. The stackable block structure of claim 16 wherein each of said connectors is one of a dovetail shaped notch and a dovetail shaped key.

18. The stackable block structure of claim 7 wherein said beveled side surfaces of said third and said fourth beveled corner blocks each include a connector which is adapted to interconnect said third and said fourth beveled corner blocks.

19. The stackable block structure of claim 18 wherein each of said connectors is one of a dovetail shaped notch and a dovetail shaped key.

20. The stackable block structure of claim 7 wherein said top surface of said first beveled corner block is in a substantially horizontal plane and said front face of said first beveled corner block is in a substantially vertical plane, and wherein said front face and said top surface intersect to form a front corner, wherein said front corner is in the same horizontal plane as the top surface.

21. The stackable block structure of claim 7, wherein the a first course of blocks further includes:

a first standard block having a front face, and a top surface, said first standard block being positioned adjacent said second beveled corner block such that the front face of said first standard block and the front face of said second beveled corner block are in the same vertical plane, and wherein said fourth beveled corner block is partially stacked on top of said top surface of said first standard block.

22. The stackable block structure of claim 21, further including:

said top surface of said first standard block unit defining a locking aperture;

at least one pin hole extending through said fourth beveled corner block from the top surface of the fourth beveled corner block to the bottom surface of the fourth beveled corner block; and a second locking pin positioned in the pin hole of said fourth block so that the locking pin extends below the bottom surface of said fourth block and into the locking aperture of said first standard block to fix the position of the first course in relation to the second course.

23. The stackable block structure of claim 7, wherein the a first course of blocks further includes:

a first standard block having a front face, and a top surface, said first standard block being positioned adjacent said first beveled corner block such that the front face of said first standard block and the front face of said first beveled corner block are in the same vertical plane, and wherein said third beveled corner block is partially stacked on top of said top surface of said first standard block.

24. The stackable block structure of claim 23, wherein said third beveled corner block further includes a second pin hole extending through said third beveled corner block from the top surface of the third beveled corner block to the bottom surface of the third beveled corner block, said stackable block structure further including:

a second locking pin positioned in the second pin hole of said third beveled corner block so that the second locking pin extends below the bottom surface of said third beveled corner block and into the locking aperture of said first standard block to fix the position of the first course in relation to the second course.

25. A comer block unit for use in creating a comer in a stackable block structure having a plurality of stacked courses, each course including a plurality of blocks, said courses being interlockable with at least one locking pin, said comer block unit comprising:

a front face;

a back surface opposite said front face;

a top surface extending between said front face and said back surface;

a bottom surface extending between said front face and said back surface;

a pin hole extending between said top surface and said bottom surface, said top surface including a locking aperture so that the locking pin inserted through the pin hole of one of the blocks in the course above extends into said locking aperture; and a beveled side surface extending between the front face and the back surface at an angle so that the front face is longer than the back surface, said beveled side surface including a connector which is adapted to interconnect said block unit with another block unit.

26. The comer block unit of claim 25 wherein the length of the block is between about 17 and about 18 inches, and the length of the first portion of the block being between about 6 and about 7 inches.

27. The comer block unit of claim 25 wherein said connector is one of a dovetail shaped notch and a dovetail shaped key.

28. The comer block unit of claim 25 wherein said block includes a first end adjacent said beveled side surface and a second end opposite said beveled side surface, and the block has a length defined by the distance along said front face between said first and second ends; and a cut groove in said block unit to facilitate cutting of said unit, said cut groove defining a first portion of the block unit having a length defined by the distance along said front face from said cut groove to said second end, said length of the first portion being less than half the length of the block.

* * * * *